US006012810A

United States Patent [19]

Ohashi

[11] Patent Number: 6,012,810

[45] Date of Patent: Jan. 11, 2000

[54] RECORDING APPARATUS

[75] Inventor: Tetsuyo Ohashi, Yokohama, Japan

[73] Assignee: Canon Kabushiki Kaisha, Tokyo, Japan

[21] Appl. No.: 09/081,022

[22] Filed: May 19, 1998

[30] Foreign Application Priority Data

May 23, 1997 [JP] Japan ..... 9-150384
May 15, 1998 [JP] Japan ..... 10-152001

[51] Int. Cl.[7] ..... B41J 13/00

[52] U.S. Cl. ..... 347/104; 271/145

[58] Field of Search ..... 347/105, 152, 347/222; 346/107.6, 134; 399/393; 271/145

[56] References Cited

U.S. PATENT DOCUMENTS 4,888,602 12/1989 Watanabe et al. ..... 347/104 X
5,517,226 5/1996 Uehara et al. ..... 347/104
5,924,805 7/1999 Belave et al. ..... 347/222 X

*Primary Examiner*—Susan S. Y. Lee
*Attorney, Agent, or Firm*—Fitzpatrick, Cella, Harper & Scinto

[57] ABSTRACT

A recording apparatus having a main body, a recording element disposed in the vicinity of a front side of the main body and adapted to record an image on a sheet, a sheet supporting unit disposed in the vicinity of a rear side of the main body and arranged in a side-by-side relation to the recording element and adapted to support the sheet to be supplied to the recording element, and a lift/lower member for lifting and lowering one of the recording element and the sheet supporting unit, and wherein, when one of the recording element and the sheet supporting unit is lifted or lowered by the lift/lower member from a side-by-side relation condition, the sheet supporting unit can be dismounted from the main body at the front side.

15 Claims, 8 Drawing Sheets

RECORDING APPARATUS

BACKGROUND OF THE INVENTION

1. Field of the Invention

The present invention relates to a recording apparatus for recording an image such as a character, a figure and the like on a sheet.

2. Related Background Art

Among such recording apparatuses, there has been proposed a recording apparatus in which sheets (for example, cut sheets) are supplied one by one from a sheet stack to a recording portion where an image is recorded on the supplied sheet.

In such a recording apparatus, various kinds of arrangements between a sheet stacking portion and a recording portion have been already known.

For example, a sheet stacking portion is disposed at a rear part of an apparatus and the recording is effected at a recording portion disposed at a front part of the apparatus, or, a sheet stacking portion is disposed at a lower part of an apparatus and the recording is effected at a recording portion disposed at an upper part of the apparatus.

Further, there has been proposed a recording apparatus in which all of operations regarding the recording can be effected from one side of a frame of the recording apparatus so that any article can be rested on the recording apparatus or the recording apparatus can be housed within shelves.

Such a recording apparatus will be briefly described with reference to FIG. 9. FIG. 9 is a schematic explanatory view showing a conventional recording apparatus.

As shown, a recording apparatus 100 comprises a frame 101 within which a sheet cassette 102 in which sheets such as paper sheets are stacked, and a recording means 104 for recording an image on the sheet conveyed along a convey path 103 are housed.

Further, as shown, the convey path 103 serves to reverse the sheet in a U-turn manner within the apparatus and then to direct the sheet to the recording means 104 disposed at an upper part of the apparatus and then to discharge the recorded sheet out of the apparatus.

In FIG. 9, a side "A" shows an operation side from which the sheet cassette is mounted or dismounted, and the recorded sheet is discharged toward the side A.

As a similar arrangement, the sheet cassette 102 may be mounted or dismounted from a front side (front side of the plane of FIG. 9) of the apparatus and the recorded sheets may be discharged within the frame 101 and be removed from the front side. That is to say, the mounting and dismounting of the sheet cassette may be effected along a direction perpendicular to a sheet conveying direction within the frame 101 and the recorded sheets may be removed along such a direction.

In the recording apparatus having such a convey path, primarily, the sheet cassette is attached to the recording apparatus by fitting projections provided on the sheet cassette into recesses formed (at predetermined positions) within the apparatus.

Alternatively, the sheet cassette may be fixed by a latch lever of the recording apparatus and the sheet cassette can be dismounted by releasing the latch lever.

However, the above-mentioned conventional technique has the following disadvantages.

Since the sheet must be reversed in the U-turn manner along the small radius, it is difficult to convey a sheet having great resiliency (for example, a thick sheet).

Further, since the sheet is slidingly contacted with the convey path at the U-turn portion, the sheet is subjected to a great load, with the result that a sheet conveying force must be increased. To this end, contact pressure of a convey roller must be increased or torque of a motor must be increased.

Further, there is great possibility of jamming the sheet within the sheet convey path since the sheet is conveyed along the complicated convey path. In such a case, since the recording apparatus cannot be manipulated from various directions other than the one side, it is very difficult to perform the sheet jam treatment (removal of the jammed sheet).

The provision of the U-turn portion in the sheet convey path within the recording apparatus not only makes the entire recording apparatus bulky but also causes various problems.

However, in the conventional techniques, since conveying accuracy (positioning accuracy) was insufficient, the U-turn portion had to be provided in the sheet convey path. Namely, by providing the U-turn portion to form a convey path having a predetermined length, a sheet conveying condition achieved by various convey rollers is optimized so that an image forming position on the sheet is determined accurately.

Further, in the conventional techniques, since the sheet cassette can be dismounted during the recording operation, if the operator erroneously dismounts the sheet cassette during the recording operation, the recording operation will be interrupted.

SUMMARY OF THE INVENTION

The present invention aims to eliminate the above-mentioned conventional drawbacks, and an object of the present invention is to provide a recording apparatus in which positioning accuracy can be improved and a convey path is made more simple, thereby enhancing functionality and operability.

To achieve the above object, according to the present invention, there is provided a recording apparatus comprising a main body, a recording means disposed at a front side of the main body and adapted to record an image on a sheet, a sheet supporting means disposed at a rear side of the main body and arranged in a side-by-side relation to the recording means and adapted to support the sheets to be supplied to the recording means, and a lift/lower means for lifting and lowering one of the recording means and the sheet supporting means, and wherein, when one of the recording means and the sheet supporting means is lifted or lowered by the lift/lower means from a side-by-side relation condition, the sheet supporting means can be dismounted from the main body at the front side.

DETAILED DESCRIPTION OF PREFERRED EMBODIMENTS

The present invention will now be fully explained in connection with embodiments thereof with reference to the accompanying drawings. However, it should be noted that dimensions, material, configurations and relative arrangement of elements described in the embodiments do not limit the present invention, except for particular limitation.

FIGS. 1 to 7 show a recording apparatus according to a first embodiment of the present invention.

First of all, the entire construction of the recording apparatus will be described.

Figure 1:
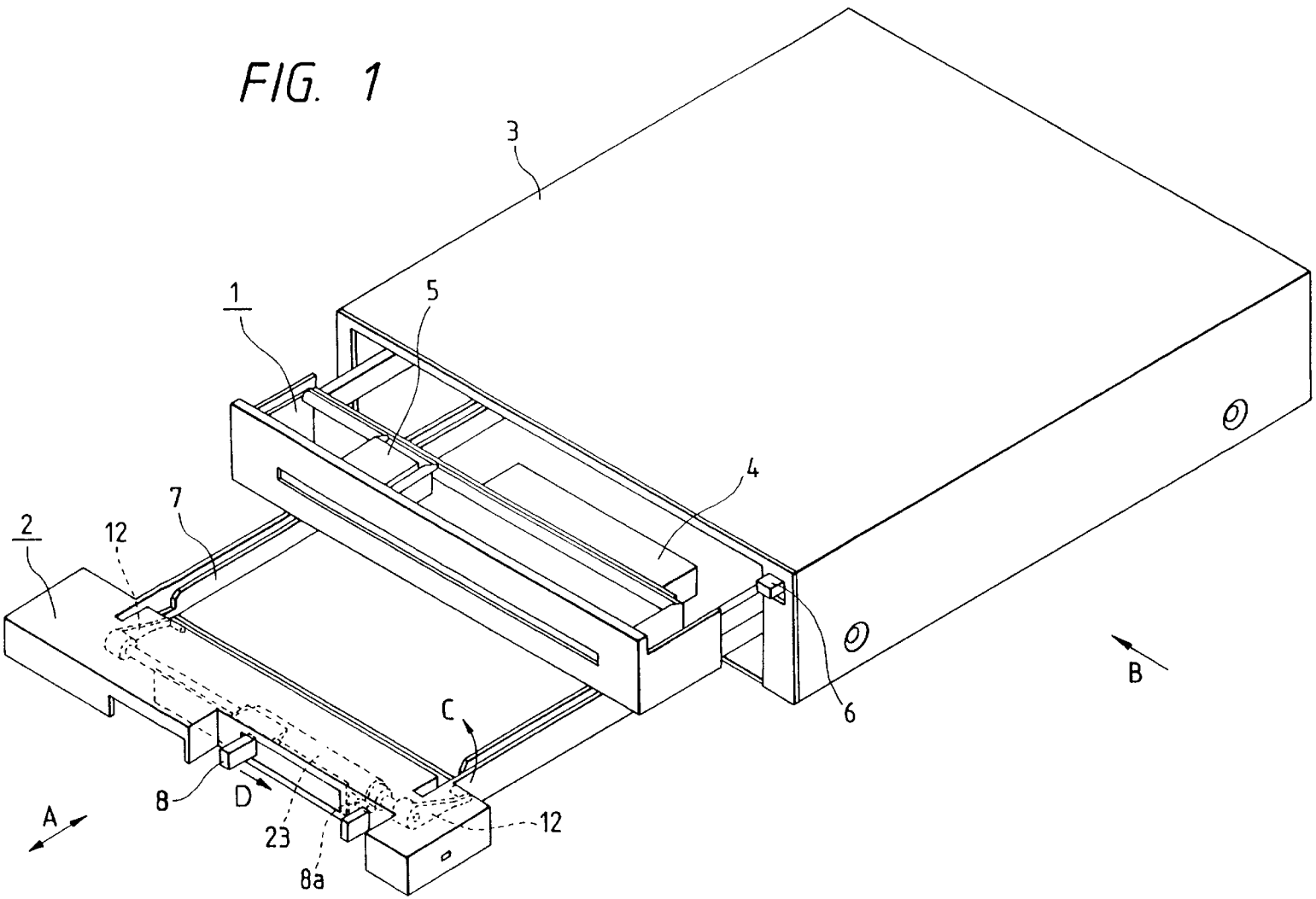
FIG. 1 is a schematic perspective view of a recording apparatus according to a first embodiment of the present invention.
Figure 2:
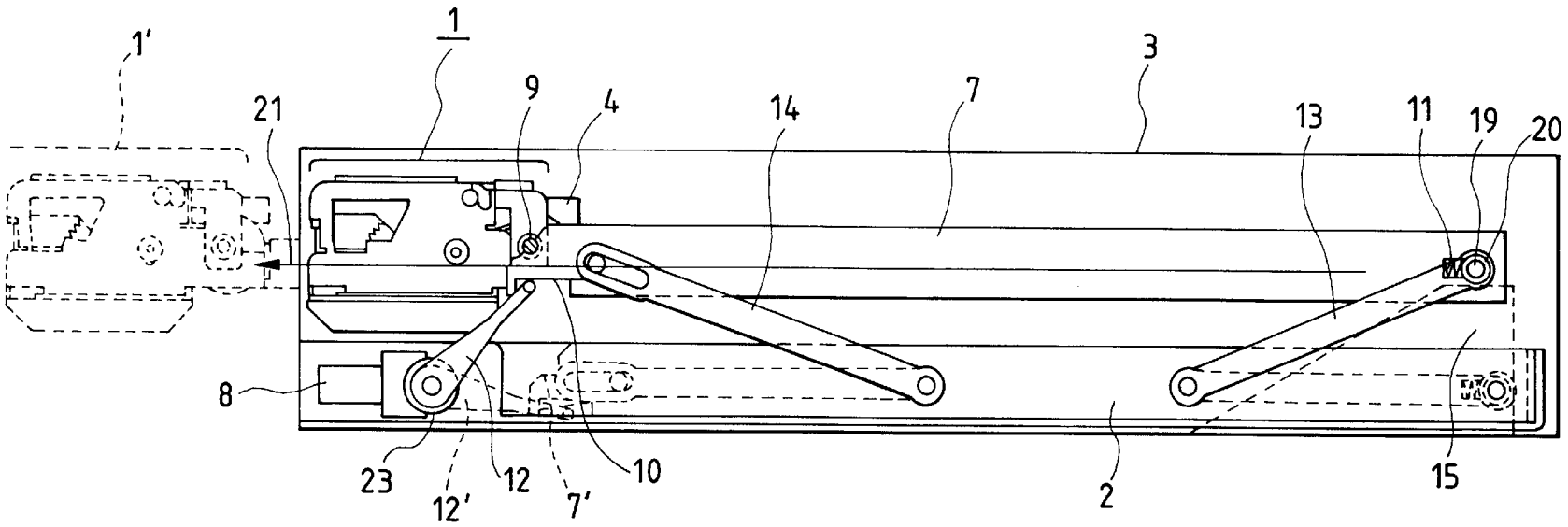
FIG. 2 is a schematic sectional view of the recording apparatus according to the first embodiment of the present invention.

FIG. 1 is a schematic perspective view of the recording apparatus according to the first embodiment of the present invention, and FIG. 2 is a schematic sectional view of the recording apparatus (looked at from a lateral side of the recording apparatus of FIG. 1).

In FIGS. 1 and 2, a recording portion (recording means) 1 can be shifted in directions shown by the double-headed arrow A.

Although various recording means can be used in the recording portion 1, in the illustrated embodiment, an ink jet printer of so-called serial scanning type is used.

A sheet cassette (sheet containing means) 2 can be mounted and dismounted along the directions A and can be removed completely from a main body 3 of the recording apparatus.

The main body 3 is constituted by a box-shaped member having an open front side so that the recording portion 1 and the sheet cassette 2 can be manipulated (insertion and removal) through the open front side.

An automatic sheet supply portion 4 is integrally provided on the recording portion 1 and serves to supply sheets contained (stacked) in the sheet cassette 2 one by one.

A recording head 5 is mounted on a carriage within the recording portion 1. The recording head 5 is constituted by an ink jet head for recording an image on the sheet while effecting reciprocal scanning movement.

A recording portion releasing lever 6 is used when the recording portion 1 is removed from the main body 3.

A sub-sheet cassette (sheet supporting means) 7 is disposed within the sheet cassette 2 and can be shifted to a predetermined position at a rear side of the recording portion 1 after the sheet cassette 2 is mounted within the main body 3.

A sheet cassette knob 8 serves to shift the sub-sheet cassette 7 to the predetermined position and constitutes a positioning means.

A cassette locking pawl 8*a* is integrally formed with the sheet cassette knob.

Sub-sheet cassette lift levers 12 serve to shift the sub-sheet cassette 7.

Main structural elements of the recording apparatus are the recording portion 1 and the sheet cassette 2, and the operator mainly manipulates these elements.

FIG. 1 shows a condition that the elements are manipulated by the operator (condition that the recording portion 1 and the sheet cassette 2 are drawn).

In this way, by manipulating the recording portion releasing lever 6, the recording portion 1 can be drawn out of the recording apparatus at a front side thereof (hereinbelow, such a condition of the recording portion 1 is referred to as "release condition").

When the recording head 5 is changed to a new one (i.e., when the ink is used up or when a color recording head is changed to a mono-color recording head or vise versa) or when the jammed sheet is removed (jam treatment), the recording portion 1 is brought to the release condition by the operator.

The recording portion 1 is slid (protruded) up to a position shown in FIG. 1 and stopped substantially at that position. And, the recording portion is prevented from further shifting from that position.

FIG. 1 further shows a condition that the sheet cassette 2 is being dismounted or mounted by the operator.

Although described later fully, after the sheet cassette knob 8 is released, by pulling or pushing the sheet cassette 2 itself while gripping a grip of the cassette, the sheet cassette can be dismounted from or mounted on the main body 3.

When the sheets stacked in the sheet cassette have been used up or when sheets are changed to different recording sheets or when the jammed sheet is removed, the sheet cassette 2 is dismounted and then is mounted again by the operator.

As mentioned above, both the recording portion 1 and the sheet cassette 2 can be slid reciprocally in the directions shown by the arrow A.

In order to bring the recording apparatus to a record permitting condition, when the recording portion 1 is pushed (inserted) into the main body 3, the recording portion 1 is engaged by a latch lever (not shown), with the result that the recording portion 1 is fixed at a predetermined position with respect to the main body 3.

Incidentally, the recording portion releasing lever 6 serves to release the engagement between the latch lever and the recording portion.

FIG. 2 is a sectional view showing a condition that the recording portion 1 and the sheet cassette 2 are completely mounted within the main body 3 to permit the recording (looked at from a lateral side (shown by the arrow B) in FIG. 1).

In FIG. 2, the same elements as those shown in FIG. 1 are designated by the same reference numerals and explanation thereof will be omitted.

In FIG. 2, a positioning pin 9 for positioning the recording portion 1 and the sheet cassette 2 is secured to the recording portion 1.

An upwardly biasing spring (biasing means) 10 serves to elastically bias the sub-sheet cassette 7 upwardly. The upwardly biasing spring 10 is constituted by a cantilever leaf spring secured to a bottom of the sub-sheet cassette 7 (refer to FIG. 3).

Forwardly biasing springs (biasing means) 11 serve to elastically bias the sub-sheet cassette 7 toward the recording portion 1 (in a horizontal direction).

Sub-sheet cassette lift levers 12 cooperate with the sheet cassette knob 8 via a cylindrical cam 23.

Each of rear side sheet cassette links 13 has one end connected to the sheet cassette 2 and the other end connected to the sub-sheet cassette 7 via the corresponding forwardly biasing spring 11.

Each of front side sheet cassette links 14 has one end connected to the sheet cassette 2 and the other end slidable with respect to the sub-sheet cassette 7.

Cassette lift cams 15 serve to lift a rear end of the sub-sheet cassette 7 as the sheet cassette 2 is inserted into the main body 3.

Each of the rear side sheet cassette links 13 is rotatably supported by a rear end sub-roller 20 mounted on a rear end shaft 19.

The cylindrical cam 23 is secured to the sub-sheet cassette lift levers 12.

Initial positions (before shift) of elements are shown by the solid lines and shifted positions (after shift) of elements are shown by the broken lines, and the shifted elements are designated by the same reference numerals with suffix "'" added.

That is to say, in FIG. 2, the recording portion shifted to the release condition is designated by the reference numeral 1', the sub-sheet cassette contained in the sheet cassette 2 which was drawn out of the main body is designated by the reference numeral 7', and the sub-sheet cassette lift levers before the sheet cassette knob 8 is manipulated after the sheet cassette 2 is mounted within the main body 3 are designated by the reference numeral 12'.

Next, an operation for bringing the sheet cassette 2 from the condition shown in FIG. 1 to the condition shown in FIG. 2 (operation for bringing the sheet cassette 2 from the drawn condition to the mounted condition) will be explained.

In this regard, a case where the recording portion has already been mounted will be described. As mentioned above, the recording portion 1 is positioned with respect to the main body 3 by means of the latch lever (not shown).

Accordingly, dismounting and mounting operations which will be described hereinbelow are effected when the recording sheets are replenished or when the recording sheets are replaced by different recording sheets.

First of all, in the condition that the sheet cassette 2 is drawn as shown in FIG. 1, the sub-sheet cassette 7 and the sub-sheet cassette lift levers 12 are located at the positions shown by the broken lines in FIG. 2 (i.e., the sub-sheet cassette is located at the position 7' and the sub-sheet cassette lift levers are located at the position 12').

In this condition, when the sheet cassette 2 is inserted into the main body 3, firstly, the rear end sub-rollers 20 abut against the corresponding cassette lift cams 15.

Due to the operator's force for inserting the sheet cassette 2, the rear end sub-rollers 20 start to be lifted along the corresponding cassette lift cam 15. In a condition that the sheet cassette 2 is completely inserted, the rear end sub-rollers 20 ride over top flat portions of the corresponding cassette lift cams 15.

In this condition, the rear end (rear end shaft 19) of the sub-sheet cassette 7 is lifted while maintaining the front end at the initial position, with the result that the entire sub-sheet cassette 7 is inclined.

Figure 3:
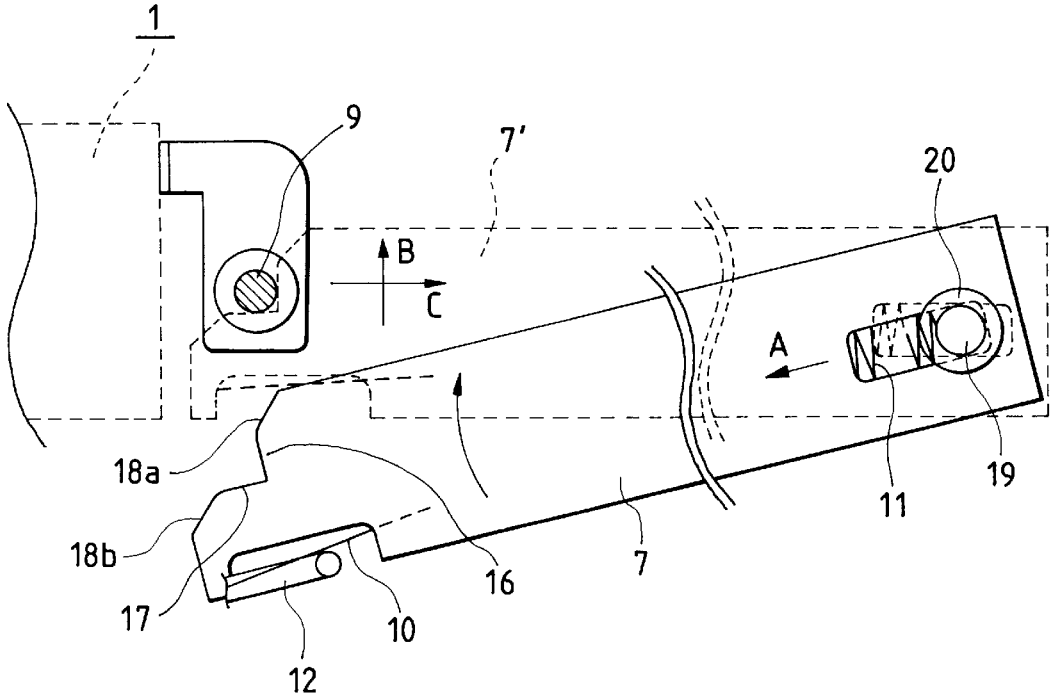
FIG. 3 is a schematic view showing a positioning mechanism of the recording apparatus according to the first embodiment of the present invention.

FIG. 3 shows a positional relation between the recording portion 1 and the sheet cassette 2 in this condition.

In FIG. 3, the sub-sheet cassette 7 has a front-rear positioning surface (abutment surface) 16 for positioning the recording portion 1 and the sub-sheet cassette 7 along the horizontal direction (in a front-and-rear direction), an up-down positioning surface (abutment surface) 17 for positioning the recording portion 1 and the sub-sheet cassette 7 in an up-and-down direction, and a guide inclined surface 18*a* which is smoothly guided by the positioning pin 9.

When the sheet cassette 2 is completely inserted into the main body 3, positioning holes (not shown) formed in the sheet cassette 2 are fitted onto cassette positioning pins 22 (FIGS. 4 and 5A and 5B) of cassette guides 25 formed integrally with the cassette lift cams 15 secured to the main body 3, thereby positioning the sheet cassette.

Further, the sheet cassette 2 abuts against sheet cassette abutment surfaces 25*a* (FIGS. 5A and 5B) of the cassette guides 25, with the result that the sheet cassette is also positioned with respect to the cassette inserting direction.

Then, in the condition that the sheet cassette 2 is completely inserted into the main body 3, the sheet cassette knob (slide member) 8 is manipulated.

When the sheet cassette knob 8 is shifted from the position shown in FIG. 1 toward a direction shown by the arrow D, a projection (not shown) provided on the sheet cassette knob 8 is engaged by a helical cam groove 23*a* (FIG. 5A) formed in the cylindrical surface of the cylindrical cam 23, with the result that a straight movement of the sheet cassette knob 8 is converted into a rotational movement of the cylindrical cam 23.

Due to this rotational movement, the sub-sheet cassette lift levers (rotary members) 12 secured to the cylindrical cam 23 are rotated in a direction shown by the arrow C in FIG. 1.

When the sheet cassette knob 8 is shifted to a predetermined position, the projection (not shown) reaches a flat portion 23*b* of the helical cam groove 23*a* of the cylindrical cam 23, thereby finishing the rotational movement of the sub-sheet cassette lift levers 12.

So long as the projection of the sheet cassette knob 8 is caught by the flat portion 23*b*, a force rotating the sub-sheet cassette lift levers 12 in a direction opposite to the direction C is resisted by the cylindrical cam 23, thereby preventing the sheet cassette knob 8 from returning to the initial position.

By manipulating the sheet cassette knob 8 in this way, the sub-sheet cassette lift levers 12 are shifted from the position shown by the broken line to the position shown by the solid line in FIG 2.

Next the role of the cassette lock pawl 8*a* during the above operation will be described.

Figure 4:
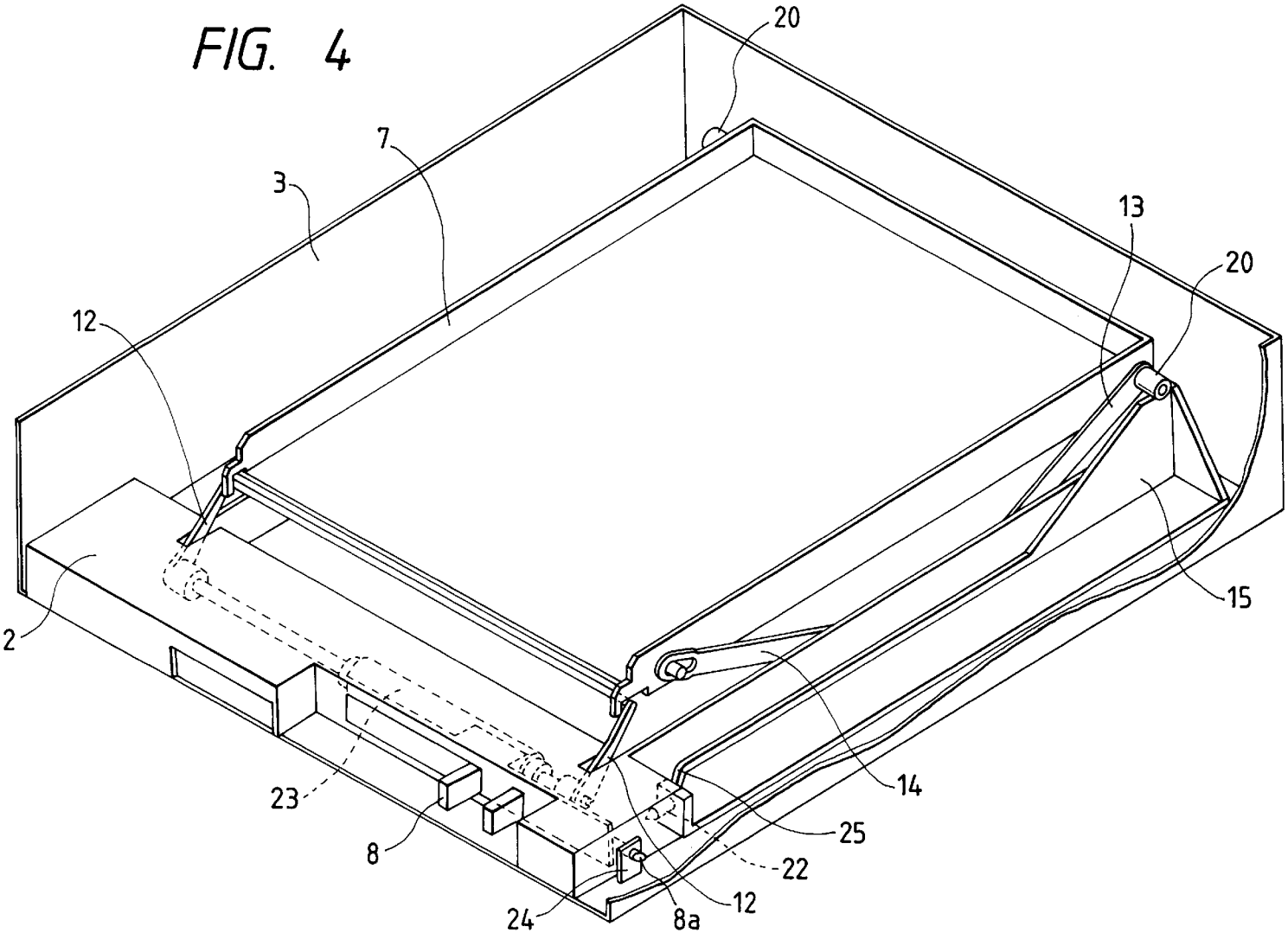
FIG. 4 is a schematic perspective view of a main part of the recording apparatus according to the first embodiment of the present invention, in a mounting condition.

FIG. 4 is a perspective view showing only elements which are required for explanation.

In FIG. 4, the cassette guides (acting as guides when the sheet cassette 2 is inserted) 25 formed integrally with the cassette lift cams 15 are provided with the respective cassette positioning pins 22 for engaging with the sheet cassette 2, and the cassette lock pawl 8*a* can be engaged by the cassette lock hole 24.

Figure 5A:
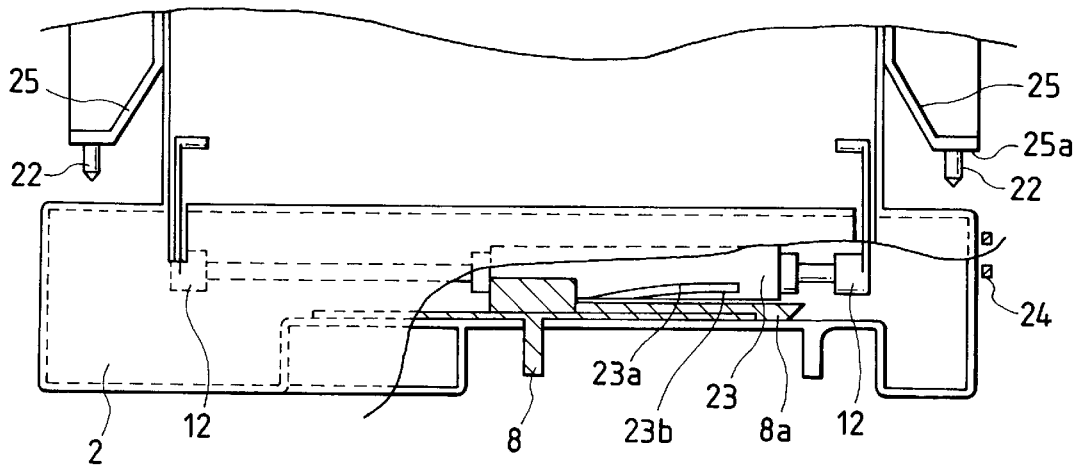
FIGS. 5A and 5B are schematic plan views of a main part of the recording apparatus according to the first embodiment of the present invention, before and after mounting, respectively.
Figure 5B:
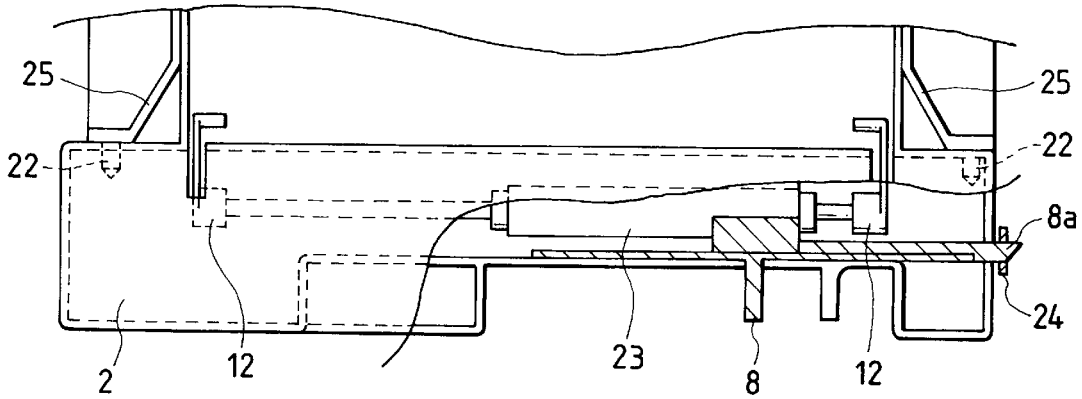

FIGS. 5A and 5B are schematic plan views of the recording apparatus, before insertion and after insertion (similar to FIG. 4), respectively.

As shown in FIGS. 5A and 5B, the cassette lock pawl 8*a* is constituted by a projection integrally formed with the sheet cassette knob 8 to be slid together with the sheet cassette knob 8.

As shown in FIG. 5A, in a condition before the sheet cassette is inserted, the cassette lock pawl 8*a* is situated within the sheet cassette 2.

FIG. 5B shows a condition that the manipulation of the sheet cassette knob 8 is completed after the sheet cassette 2 was inserted.

As the sheet cassette knob 8 is shifted from the condition shown in FIG. 5A to the condition shown in FIG. 5B, the sub-sheet cassette lift levers 12 are shifted to the position shown by the solid line in FIG. 2.

When the sheet cassette knob 8 is brought to the condition shown in FIG. 5B, the cassette lock pawl 8*a* is protruded from the lateral surface of the sheet cassette 2 and is inserted into the cassette lock hole 24 formed in the main body 3.

In this case, since an inclined surface is formed on a tip end of the cassette lock pawl 8*a*, even if the sheet cassette knob 8 is manipulated before the sheet cassette 2 abuts against the sheet cassette abutment surfaces 25*a* completely, the tip end of the cassette lock pawl 8*a* can surely be inserted into the cassette lock hole 24.

Due to a force component of a force generated when the inclined surface of the tip end of the cassette lock pawl 8*a* is slid on the wall defining the cassette lock hole 24, the sheet cassette 2 is pushed toward the sheet cassette abutment surfaces 25*a*. Thus, when the manipulation of the sheet cassette knob 8 is completed, the sheet cassette 2 is shifted up to the predetermined position.

Consequently, the sheet cassette 2 is prevented from being fixed at any position other than the predetermined position.

By manipulating the sheet cassette knob 8 in this way, the sub-sheet cassette 7 is positioned with respect to the sheet cassette 2 and, at the same time, the sheet cassette 2 is positioned with respect to the main body 3.

That is to say, the sub-sheet cassette 7 and the sheet cassette 2 are simultaneously positioned with respect to the main body 3 and the recording portion 1.

When the manipulation of the sheet cassette knob 8 is once completed, since the sheet cassette 2 is fixed by the cassette lock pawl 8*a*, the operator cannot draw or dismount the sheet cassette 2 erroneously during the recording operation.

Next, the positioning of various elements will be described more in detail.

As mentioned above, when the sheet cassette 2 is mounted within the main body 3 and the sub-sheet cassette lift levers 12 are shifted to the position shown by the solid line in FIG. 2, the sub-sheet cassette 7 and the recording portion 1 are positioned as follows.

That is to say, the sub-sheet cassette lift levers 12 abut against the upwardly biasing springs 10 and the sub-sheet cassette 7 is elastically biased upwardly by the sub-sheet cassette lift levers 12 via the upwardly biasing springs 10.

Further, the rear end shafts 19 are positioned by the rear side sheet cassette links 13, and the sub-sheet cassette 7 is biased by the forwardly biasing springs 11 toward the direction A in FIG. 3 along the guide grooves of the rear end shafts 19.

Thus, when the sub-sheet cassette 7 is shifted from the position 7 to the position 7' in FIG. 3, the positioning portion is shifted while abutting against and being biased by the positioning pin 9.

Accordingly, the guide inclined surface 18*a* firstly abuts against the positioning pin 9 which is stationary.

Due to a force component of a force acting on the guide inclined surface 18*a*, the sub-sheet cassette 7 is shifted toward the direction along which the upwardly biasing springs 10 and the forwardly biasing springs 11 are compressed. When the sub-sheet cassette lift levers 12 are lifted up to the predetermined position, the positioning pin 9 abuts against the front-rear positioning surface 16 and the up-down positioning surface 17 and is stopped there.

In this condition, since there is no gap between the positioning pin 9 and the front-rear positioning surface 16 and the up-down positioning surface 17, the relative position between the recording portion 1 and the sub-sheet cassette 7 in the directions B, C in FIG. 3 is determined correctly and accurately.

Now, a mechanism for determining the relative position in a direction perpendicular to the sheet conveying direction in FIG. 3 will be explained with respect to FIG. 6.

Figure 6:
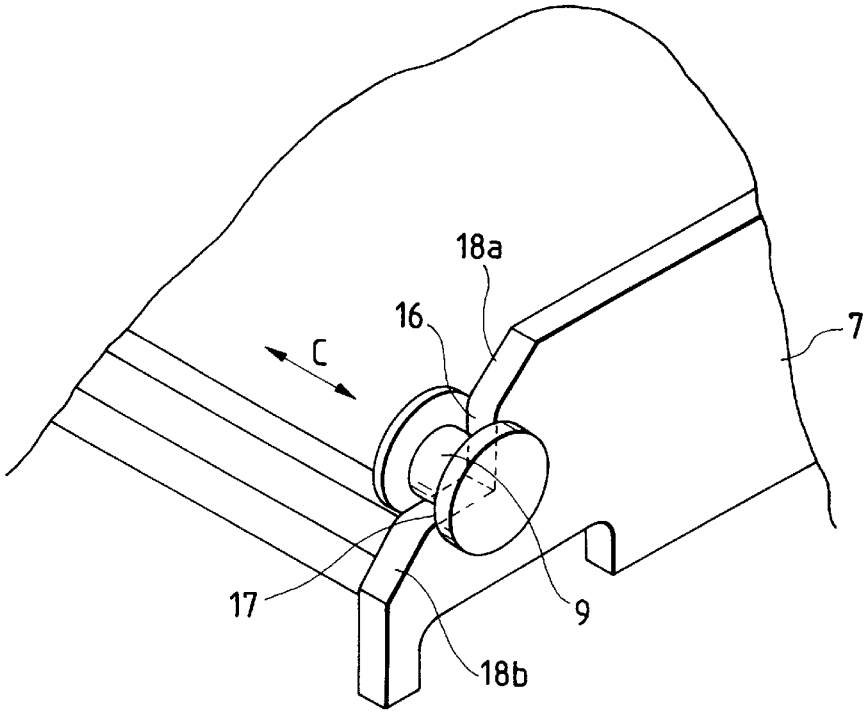
FIG. 6 is a schematic perspective view showing a positional relation of main parts of the recording apparatus according to the first embodiment of the present invention.

FIG. 6 is a schematic perspective view showing a relative position between the positioning pin 9 and the sub-sheet cassette 7.

The positioning pin 9 is provided at its both ends with conical plates each having a diameter greater than a diameter of the pin.

The length of the positioning pin 9 in the direction C in FIG. 6 is selected to become slightly greater than the widths of the front-rear positioning surface 16 and the up-down positioning surface 17.

Thus, the sub-sheet cassette 7 is shifted to a predetermined position while being guided by tapered surfaces of the conical plates. The other positioning pin 9 is constituted by only a pin portion having a sufficient length.

With this arrangement, since the relative position between the positioning pin 9 and the sub-sheet cassette 7 in the direction C in FIG. 6 is determined correctly, the relative position between the recording portion 1 and the sub-sheet cassette 7 is also determined correctly.

When the sheet cassette 2 is dismounted from the main body 3, the above operations are effected reversely. Namely, by manipulating the sheet cassette knob 8, the sub-sheet cassette lift levers 12 are lowered and the cassette lock pawl 8*a* is released. Then, by drawing or pulling the sheet cassette 2, the rear end sub-rollers 20 are rolling down along the cassette lift cams 15. In this way, the sheet cassette 2 can be dismounted while shifting the sub-sheet cassette 7 to the position 7' in FIG. 2.

Next, a case where the sheet cassette 2 is already inserted and the recording portion 1 is mounted (from the drawn condition) within the main body 3, i.e., a case where the sub-sheet cassette 7 is located at the position 7 in FIG. 2 and the recording portion 1 is shifted from the position 1' in FIG. 2 to the position 1 will be explained.

Regarding the sub-sheet cassette 7, the rear end shafts 19 are located at the predetermined position, and the sub-sheet cassette 7 is shifted forwardly by the forwardly biasing springs 11 so that the front end of the sub-sheet cassette is lifted by the upwardly biasing springs 10. This condition is shown in FIG. 7.

Figure 7:
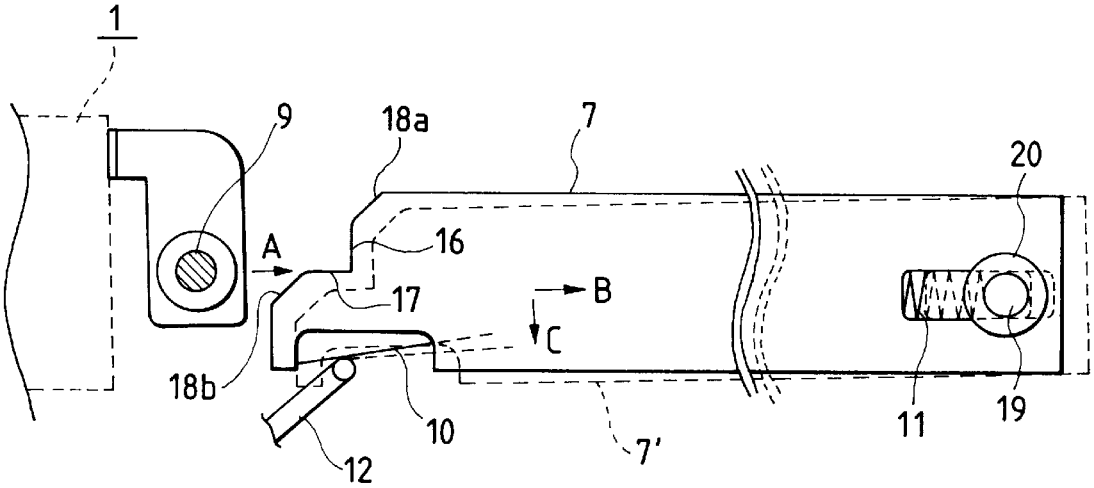
FIG. 7 is a schematic view showing a positioning mechanism of the recording apparatus according to the first embodiment of the present invention.

From the condition shown in FIG. 7, when the recording portion 1 is shifted (slid) along translation guides (not shown) toward a direction shown by the arrow A, the positioning pin 9 firstly abuts against the guide inclined surface 18*b*.

Then, due to a force component of a force acting on the guide inclined surface 18*b*, the sub-sheet cassette 7 is shifted to directions shown by the arrows B and C in FIG. 7.

As a result, the upwardly biasing springs 10 are compressed and the forwardly biasing springs 11 are also compressed.

After the positioning pin 9 rides over the guide inclined surface 18*b*, it slides on the up-down positioning surface 17 and abuts against the front-rear positioning surface 16. Then, the positioning pin 9 is shifted while abutting against the positioning surfaces 17, 16 until the positioning pin is stopped at the predetermined position.

When the positioning pin 9 is stopped at the predetermined position, the condition shown in FIG. 2 is obtained.

Thus, even when the recording portion 1 is mounted later, the relative position between the recording portion 1 and the sub-sheet cassette 7 is determined correctly.

By effecting the above operations reversely, the recording portion 1 can be dismounted in the condition that the sheet cassette 2 is contained within the main body 3.

As mentioned above, both during the mounting and dismounting of the sheet cassette 2 and during the mounting and dismounting of the recording portion 1, the recording portion 1 and the sub-sheet cassette 7 can be positioned correctly.

In this way, since the sub-sheet cassette 7 is lifted within the main body to be positioned with respect to the recording portion 1, as shown in FIG. 2, a sheet pass path 21 for conveying the recording sheet (uppermost sheet) supplied from the automatic sheet supply portion 4 to the recording portion 1 can be formed in the plane of the sheet stack.

That is to say, as shown, the uppermost sheet on the sheet stack is straightly conveyed as it is in the plane of the sheet stack. And, after the image is formed on the sheet in the recording portion 1, the sheet is discharged out of the apparatus as it is.

Since the recording portion 1 and the sub-sheet cassette 7 are positioned correctly, the sheet is not skewed during the conveyance of the sheet.

Due to the engagement between the cassette lock pawl 8*a* and the cassette lock hole 24, in the condition that the sheet cassette 2 is mounted, the sheet cassette 2 can be prevented from being drawn or dismounted erroneously during the recording operation.

In the recording apparatus having the above-mentioned construction, since the positioning accuracy is improved, since the sheet conveying accuracy is improved and since the convey path is simplified, unlike the conventional techniques, the U-turn path is not required, so that a sheet having great resiliency can be conveyed, thereby enhancing the functionality.

Further, since the recording sheet is not subjected to an external force from the convey path, a sheet conveying force can be reduced, thereby permitting the simple construction.

Further, since the sheet convey path is simple, the possibility of the sheet in occurring jam is reduced, and, even if the sheet jam occurs, the jammed sheet can easily be removed, thereby improving the operability.

Since the sheet cassette 2 is fixed at the predetermined position by manipulating the sheet cassette knob 8 and the manipulation of the sheet cassette knob 8 is required when the fixing of the sheet cassette is released, the erroneous removal of the sheet cassette 2 during the recording operation can be prevented, thereby improving the reliability.

In this recording apparatus, since the sheet cassette can be mounted and dismounted at the front side of the apparatus when the sheets are replenished or when the sheets are changed to different size sheets and since the maintenance of the recording portion and the sheet jam treatment can also be performed at the front side of the apparatus, for example, the apparatus can be installed between shelves, and, thus, the installation place is less limited.

In the above-mentioned first embodiment, while an example that the sheet cassette knob 8 is manipulated by the operator to lift and lower the sub-sheet cassette 7 of the sheet cassette 2 was explained, the sub-sheet cassette 7 may be automatically lifted and lowered electrically by using a motor and a mechanism for lifting and lowering the sub-sheet cassette 7 via the motor.

Figure 8A:
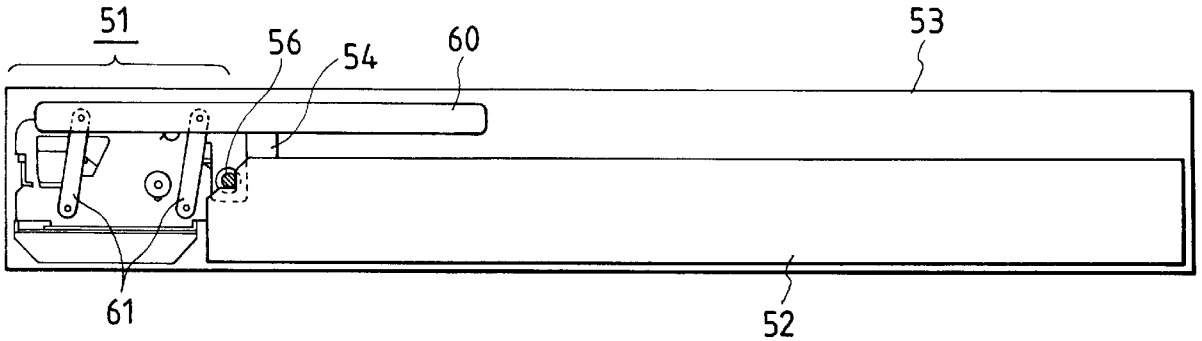
FIGS. 8A and 8B are schematic views showing a recording apparatus according to a second embodiment of the present invention.
Figure 8B:
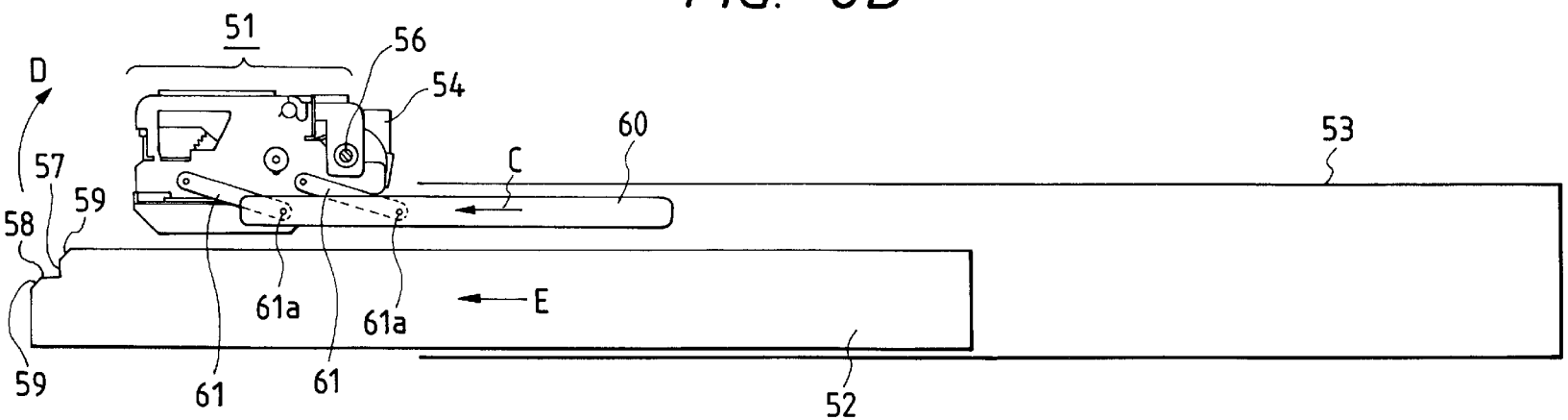
Figure 9:
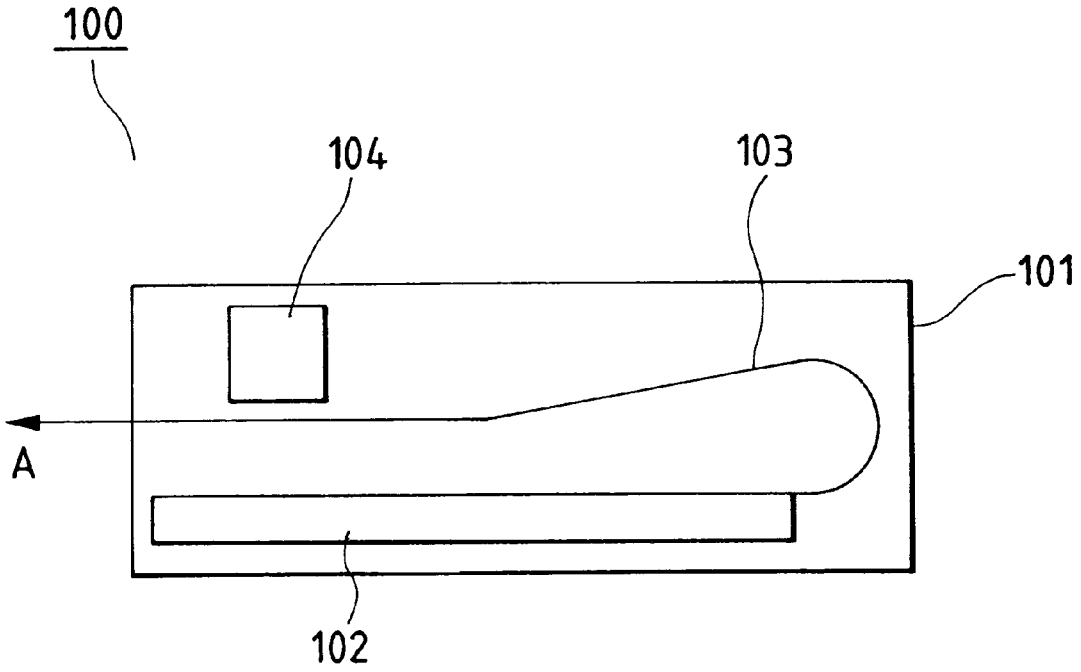
FIG. 9 PRIOR ART
FIG. 9 is a schematic explanatory view showing a conventional recording apparatus.

FIGS. 8A and 8B are schematic views showing a second embodiment of the present invention, where FIG. 8A shows a recording apparatus in a record permitting condition and FIG. 8B shows the recording apparatus in a recording portion release condition for changing a recording head and/or an ink tank or for replenishing recording sheets. In FIGS. 8A and 8B, the reference numeral 51 denotes a recording portion; 52 denotes a sheet cassette; 53 denotes a main body of the recording apparatus; 54 denotes an automatic sheet supply portion; 56 denotes a positioning pin; 57 denotes a front-rear positioning surface; 58 denotes an up-down positioning surface; 59 denotes a guide inclined surface; 60 denotes a recording portion slide guide slidably supported by the main body 53; and 61 denotes rotary links for regulating a retard position of the recording portion 51.

Now, a process from the record permitting condition shown in FIG. 8A to the recording portion release condition shown in FIG. 8B will be explained. When the recording head and/or the ink tank is changed or the recording sheets are replenished, by manipulating a recording portion releasing lever (not shown) by the operator, a series of operations are started.

When the recording portion releasing lever is manipulated, latch (not shown) for fixing the recording portion 51 is released, thereby permitting a shifting movement of the recording portion 51. The recording portion 51 is pushed out toward a direction shown by the arrow C in FIG. 8B by a biasing means (not shown) such as a spring. In this case, since the recording portion 51 is supported by the recording portion slide guide 60, the recording portion is translated in the direction C. When the recording portion is shifted to a predetermined position, the recording portion slide guide 60 is stopped by a stopper (not shown).

Next, a structure for shifting the recording portion 51 in a direction shown by the arrow D in FIG. 8B in order to retard the recording portion will be explained. The recording portion 51 is supported by two rotary links 61 which are connected to the recording portion slide guide 60 at pivot points 61*a*. When the recording portion slide guide 60 reaches a predetermined position, the latch (not shown) is released, the rotational movement toward the direction D is started by a biasing means (not shown) such as a spring, thereby achieving the condition shown in FIG. 8B. Then, the recording portion 51 is stopped.

In this condition, the recording head and/or the ink tank of the recording portion 51 can be changed. The operator can perform the above-mentioned operation. When only the manipulation of the recording portion 51 is required and the manipulation of the recording sheets is not required, the recording portion 51 is mounted within the main body 53 by effecting the above operations reversely. That is to say, first of all, the recording portion 51 is rotated in a direction opposite to the direction D until the latch (not shown) becomes effective. Thereafter, the recording portion 51 is translated in a direction opposite to the direction C so that the recording portion 51 is returned together with the recording portion slide guide 60 to the predetermined position (within the main body 53) where the latch (not shown) becomes effective. In this case, although the positioning of the sheet cassette 52 and the recording portion 51 is required, the positioning is determined by the positioning pin 56, and the front-rear positioning surface 57, up-down positioning surface 58 and guide inclined surface 59 which are provided on the sheet cassette 52. When the recording portion 51 approaches the sheet cassette 52 while being translated and guided by the recording portion slide guide 60, since the sheet cassette 52 is fixed, the positioning pin 56 is shifted along the guide inclined surface 59.

When the condition shown in FIG. 8A is approached, the rotary links 61 are biased toward the direction opposite to the direction D by a toggle spring (not shown). Thus, when the recording portion 51 is pushed-in up to the predetermined position, the positioning pin 56 abuts against the front-rear positioning surface 57 and the up-down positioning surface 58.

In this way, the recording portion 51 and the sheet cassette 52 are positioned in the front-and-rear and up-and-down directions. In this way, the recording apparatus is restored to the record permitting condition.

Next, the replenishing of the recording sheets will be explained. In the condition that the recording portion 51 is retarded upwardly as shown in FIG. 8B, the access to the sheet cassette 52 is effected. Since the recording portion 51 is retarded upwardly, a gap is created below the recording portion 51, and the sheet cassette 51 can pass through the gap. In this condition, the operator inserts his hand into the main body 53 to grip the sheet cassette 52. By shifting the sheet cassette in a direction shown by the arrow E, the sheet cassette 52 can be dismounted from the main body 53.

In the condition that the sheet cassette 52 is dismounted from the main body 53, the recording sheets are replenished or the recording sheets are changed to different recording sheets. It should be noted that the sheet cassette 52 can automatically be shifted by using a power source such as a motor.

The sheet cassette 52 can be mounted within the main body 53 again by effecting the above operations reversely. The operations for mounting the recording portion 51 within the main body 53 after the sheet cassette 52 is mounted within the main body 53 are the same as the above operations for mounting only the recording portion 51. By constructing the recording apparatus as mentioned above, the same effect as the first embodiment can be achieved.

Also in the recording apparatus according to the second embodiment, since the sheet cassette can be mounted and dismounted at the front side of the apparatus when the sheets are replenished or when the sheets are changed to different size sheets and since the maintenance of the recording portion and the sheet jam treatment can also be performed at the front side of the apparatus, for example, the apparatus can be installed between shelves, and, thus, the installation place is less limited.

What is claimed is:

1. A recording apparatus comprising:

a main body;

a recording means disposed in the vicinity of a front side of said main body to record an image on a sheet;

a sheet supporting means disposed in the vicinity of a rear side of said main body and arranged in a side-by-side relation to said recording means to support the sheet to be supplied to said recording means; and a lift/lower means for lifting and lowering one of said recording means and said sheet supporting means;

wherein when one of said recording means and said sheet supporting means is lifted or lowered by said lift/lower means from a side-by-side relation condition, said sheet supporting means can be drawable from said main body at the front side.

2. A recording apparatus according to claim 1, wherein said sheet supporting means can be lifted and lowered by said lift/lower means.

3. A recording apparatus according to claim 2, wherein said sheet supporting means is housed in a sheet containing means which is mounted within said main body at a position different from said recording means in an up-and-down direction, and said lift/lower means has a cam member for lifting and lowering one end of said sheet supporting means in response to the mounting of said sheet containing means within said main body, and a shift means for lifting and lowering the other end of said sheet supporting means.

4. A recording apparatus according to claim 3, further comprising a lock means for locking said sheet containing means to said main body when said sheet supporting means is lifted and lowered by said shift means.

5. A recording apparatus according to claim 2, wherein said recording means can slide toward the front side of said main body.

6. A recording apparatus according to claim 1, wherein said recording means is supported by said lift/lower means for lifting and lowering movements.

7. A recording apparatus according to claim 6, wherein said lift/lower means includes a slide member for supporting said recording means for forward sliding movement with respect to said main body, and a link member for lifting and lowering said recording means in a condition that said recording means is shifted forwardly.

8. A recording apparatus according to claim 1, further comprising a positioning means for positioning said recording means and said sheet supporting means in a side-by-side direction and an up-and-down direction when said recording means and said sheet supporting means are located in the side-by-side relation.

9. A recording apparatus according to claim 1, wherein said recording means effects the recording while conveying the sheet fed from said sheet supporting means substantially along a horizontal direction and discharges the recorded sheet forwardly of said main body.

10. A recording apparatus according to any one of claims 1 to 9, wherein said recording means is of ink jet type in which the image is recorded on the sheet by discharging ink from a nozzle.

11. A recording apparatus comprising:

a main body;

a recording means disposed in the vicinity of a front side of said main body to record an image on a sheet;

a sheet cassette detachably mounted to said main body from the front side of said main body;

a sub-sheet cassette disposed within said sheet cassette to support a sheet; and a link member for lifting and lowering said sub-sheet cassette between a position within said sheet cassette and a position where said sub-sheet cassette is shifted from said sheet cassette and is located in a side-by-side relation to said sheet cassette behind said recording means, in a condition that said sheet cassette is set in said main body.

12. A recording apparatus according to claim 11, wherein said link member lifts and lowers said sub-sheet cassette via a cam provided on said main body in synchronism with the mounting of said sheet cassette to said main body.

13. A recording apparatus according to claim 11, wherein said recording means is supported for sliding movement toward the front side of said main body.

14. A recording apparatus comprising:

a main body;

a recording means disposed in the vicinity of a front side of said main body to record an image on a sheet;

a link member for lifting and lowering said recording means from a recording position where the image is recorded on the sheet; and a sheet cassette containing the sheet and detachably mounted to said main body at the front side of said main body in a condition that said recording means is lifted and lowered from said recording position by said link member.

15. A recording apparatus according to claim 14, wherein said recording means is connected to a slide guide for sliding movement forwardly of said main body, and said recording means is lifted and lowered by said link member after said recording means is shifted forwardly by said slide guide.

* * * * *

UNITED STATES PATENT AND TRADEMARK OFFICE

CERTIFICATE OF CORRECTION

PATENT NO. : 6,012,810
DATED : January 11, 2000
INVENTOR(S) : Ohashi

It is certified that error appears in the above-identified patent and that said Letters Patent is hereby corrected as shown below:

Item [56] References Cited:
U.S. PATENT DOCUMENTS, the following should be inserted:
-- 5,280,331 01/1994 Namiki --.

After U.S. PATENT DOCUMENTS, the following should be inserted:
-- FOREIGN PATENT DOCUMENTS

| | | |
|---|---|---|
| 0 497 571 | 08/1992 | European Pat. Off. |
| 0 720 343 | 07/1996 | European Pat. Off. --. |

Column 4,
Line 8, "are" should read -- have been --.

Column 9,
Line 55, "sheet in occurring jam" should read -- sheet jam occurring --.

Signed and Sealed this

Ninth Day of October, 2001

*Attest:*

Nicholas P. Godici

*Attesting Officer*

NICHOLAS P. GODICI
*Acting Director of the United States Patent and Trademark Office*